United States Patent [19]

Jensen

[11] Patent Number: 4,634,118

[45] Date of Patent: Jan. 6, 1987

[54] COOPERATIVE EXERCISING APPARATUS

[76] Inventor: Peter A. Jensen, 3314 Sawtelle Blvd., #24, Los Angeles, Calif. 90066

[21] Appl. No.: 580,798

[22] Filed: Feb. 16, 1984

[51] Int. Cl.[4] ..... A63B 21/06

[52] U.S. Cl. ..... 272/117; 272/134; 272/902; 272/120

[58] Field of Search ..... 272/117, 118, 116, 93, 272/132, 131, 902, 109, 120, 134

[56] References Cited

U.S. PATENT DOCUMENTS

| | | | |
|---|---|---|---|
| 3,850,431 | 11/1974 | Winans | 272/118 |
| 3,937,461 | 2/1976 | Lew | 272/109 |
| 4,077,626 | 3/1978 | Newman | 272/132 X |
| 4,114,874 | 9/1978 | Mattila | 272/132 X |
| 4,125,257 | 11/1978 | Lew | 272/109 |
| 4,252,314 | 2/1981 | Ceppo | 272/117 |
| 4,257,590 | 3/1981 | Sullivan et al. | 272/117 |
| 4,431,184 | 2/1984 | Lew et al. | 272/109 |
| 4,449,716 | 5/1984 | Goldy et al. | 272/109 |

*Primary Examiner*—Richard J. Apley
*Assistant Examiner*—Robert W. Bahr
*Attorney, Agent, or Firm*—Paul D. Supnik

[57] ABSTRACT

Exercising apparatus includes a collapsible frame having upper and lower tracks supporting upper and lower groups of pulleys and moveable upright track supporting risers. The upper pulleys support an adjustable friction block partner supporting harness adjacent the frames front end, and a line extending from the friction block over upper pulleys to a coupling transmits a friction block enhanced force related to the partners weight. A multiple path pulley arrangement joined to the coupling provides a mechanical advantage, reducing by a multiple the effective force delivered adjacent the frame's back end to an exercising bar spaced apart from the exercising partner through lower track coupled pulley blocks. A separate line from the upper track passing through an offset pulley, is extendable to the lower lines to allow for pull down exercises. In use, a partner sits on the harness transmitting a force to the adjustable friction block which is enhanced and transmitted though the multiple pulley paths, thereby reducing the effective resistive force. That force is transmitted to exercising bars lifted or pulled by the exercising individual.

22 Claims, 11 Drawing Figures

10
3
12
25
72
54
54
62
67
67
60
84
82
24
71
66
66
80
22
18
64
74
111
68
54
90
112
73
32
34
94
114
92
63
96
92
102
110
100
16
3

54
69
54
12
67
67
34
71

22
114
110
102
16

12
62
26
82

32
24
66
74
68
75
76
76
106
106
108
108
38
36
38
100
100
16
16

COOPERATIVE EXERCISING APPARATUS

BACKGROUND OF THE INVENTION

1. Field of the Invention

This invention pertains to exercise devices. More particularly, this invention pertains to exercise equipment contemplated for cooperative use by two people.

2. Description of the Prior Art

In the past, exercise equipment was generally designed for use by a single individual or occasionally requiring use by a spotter. Many types of equipment were difficult or time consuming to set up for use by a single individual. A certain degree of human motivation is necessary to encourage regular exercise and that which has a tendency to reduce human inertia is likely to increase regular usage of the equipment. Thus, it would be desirable to have exercise equipment that would increase motivation to help develop and maintain human physical fitness.

SUMMARY OF THE INVENTION

An exercising device generally includes upper and lower supports for supporting a pulley arrangement. The pulley arrangement receives and supports the weight of a partner and transmits a force related to the partner's weight to an exercising means, such as a bar, which is grasped and pulled by the exercising individual. Means are provided for adjusting the partner related force by the partner. Thus the partner maintains control over the resistive force supplied to the exercising individual thus cooperatively participating in the exercising activity.

In a more specific example, the upper and lower supports are configured in a collapsable frame. An upper pulley group supports a harness or swing which supports the weight of the partner. A friction block, coupled to a line supporting the partner is adjustable to variably increase the force transmitted through the pulley arrangement. A lower pulley group, having multiple pulley passes, provides an advantage for reducing by a multiple the resistive force transmitted to the exercising device required to complete the exercising task. In addition, the lower pulley group comprises a pair of spaced apart pulley groups disposed in parallel for allowing exercising from either side of the exercising device, either simultaneously or independently.

Additional features in accordance with this invention include a third pulley group including a line couplable to the line extending to the exercising bar, and then extending downward from the upper support, to allow pull down exercises. The friction block includes a force sensitive transducer coupled to a display for providing an indication related to the force supplied by the exercising partner to the exercising individual. A futon extendable in a variety of different positions allows the exercising individual to engage in different types of exercises from various positions. Cables are disposed in a triangular relationship to the collapsable frame to keep the frame in a rigid relationship when in use, yet allow for the collapsing. Sliders, nominally fixed, are movable along upright portions of the frame to allow the device to be collapsed and folded when not in use.

BRIEF DESCRIPTION OF THE DRAWINGS

The nature of the invention described herein may be best understood and appreciated by the following description taken in connection with the accompanying drawings in which.

DETAILED DESCRIPTION

Figure 1:
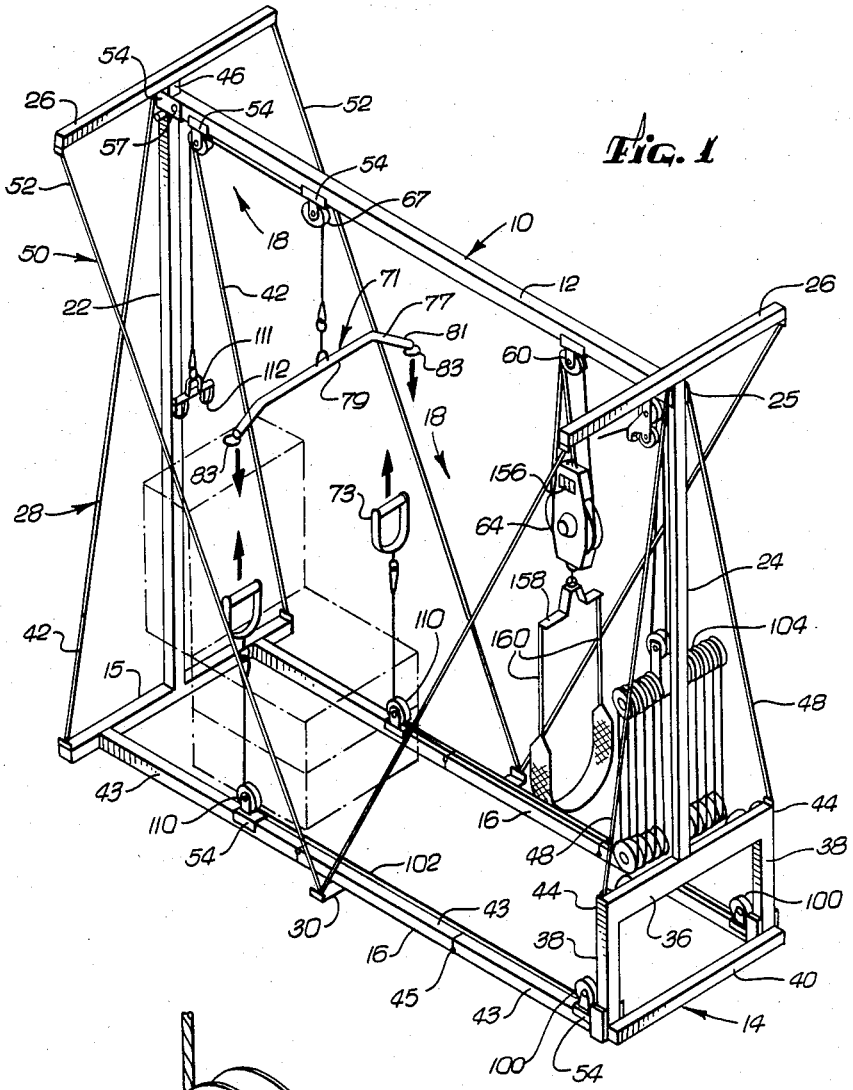
FIG. 1 is a perspective view of an exercising device in accordance with this invention.
Figure 2:
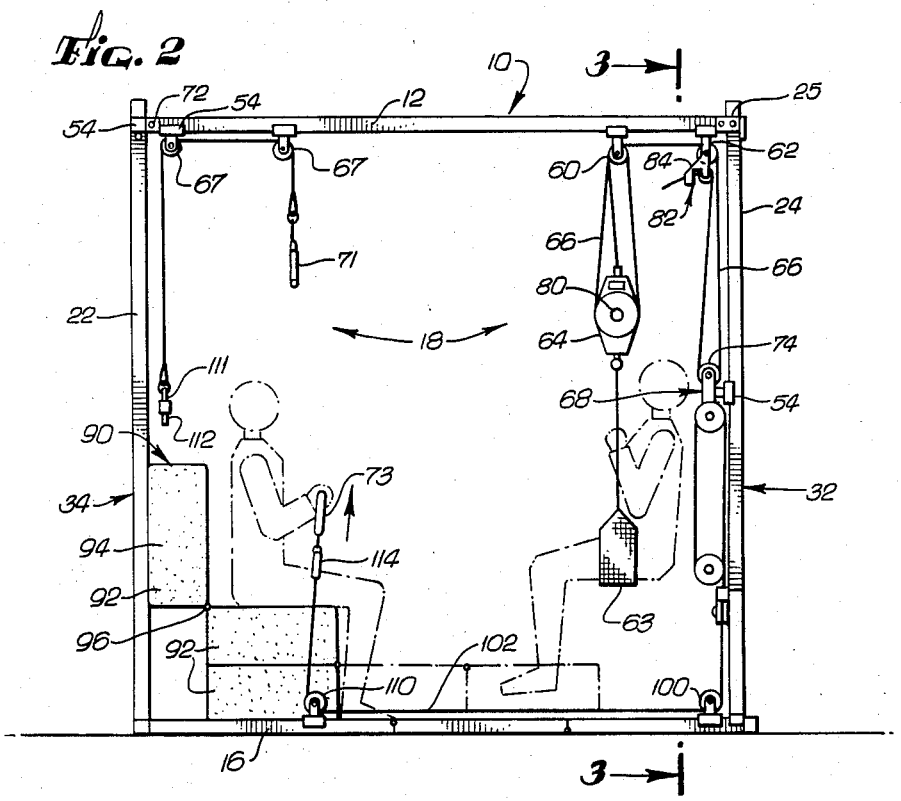
FIG. 2 is an elevational view of a portion of the invention depicted in FIG. 1.
Figure 4:
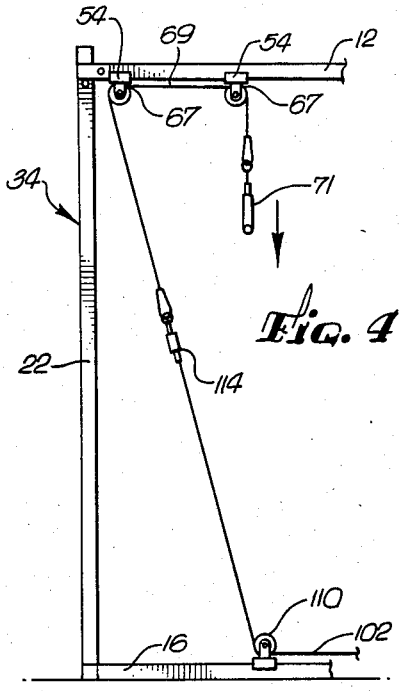
FIG. 4 is an elevational view of a portion of the invention depicted in FIG. 2 in which the device is coupled for pull down exercises in accordance with the invention.
Figure 3:
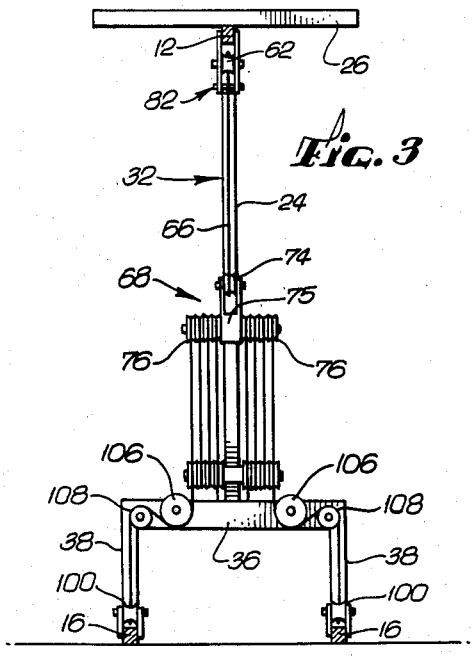
FIG. 3 is an elevational view of a portion of the invention depicted in FIG. 1 taken along lines 3—3 of FIG. 2.

With particular reference to FIGS. 1, 2 and 3, an example of an exercising device in accordance with this invention generally comprises a frame 10 having an upper support or track 12, a floor or lower support means or lower track arrangement 14 having a pair of spaced apart lower tracks 16 and a pulley arrangement 18 coupled to the upper and lower tracks 12, 16. The upper track 12 has an "H" beam cross section, as best viewed in FIG. 5, which defines a pair of lateral outwardly extending longitudinal flanges 20 disposed longitudinally along the track upper track 12.

The frame further comprises first and second spaced apart upright risers 22, 24 for coupling the lower track arrangement to the upper track 12 and supporting the upper track 12. Crossbars 26 are disposed normal to and centrally about a nominal plane of the frame 10. A structural cable arrangement 28 is used to provide rigidity to the frame and is coupled to the crossbars 26. One upper crossbar 26 is joined at the top of riser 22 adjacent the upper track 12. Another upper crossbar 26 is joined to the upper track 12, A hinge 25 joins the riser 24 to the upper track 12.

An outwardly extending member 30 disposed centrally along the lower tracks 16 extends normally outward from each of the lower tracks 16. The outwardly extending members 30 space the cable arrangement 28 sufficiently apart to avoid interfering with the exercising activity of the individuals using the apparatus. Typically, the outwardly extending members 30 space the cable arrangement 28 approximately 3 feet (1 meter) apart.

Figure 7:
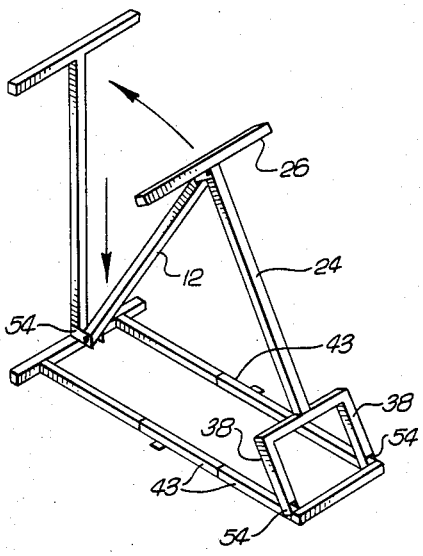
FIG. 7 is a diagrammatic perspective view of the portion of the invention as depicted in FIG. 6 showing how the device may be collapsed.
Figure 8:
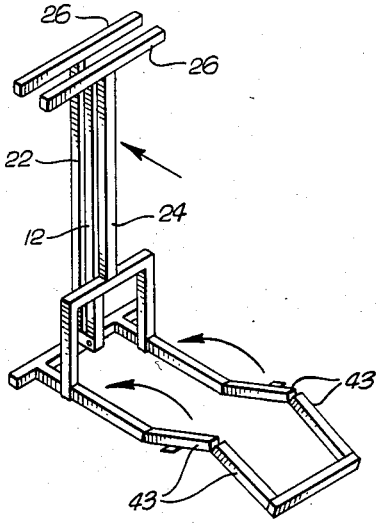
FIG. 8 is a diagrammatic perspective view of the portion of the invention as depicted in FIG. 6 further showing how the device may be collapsed.
Figure 9:
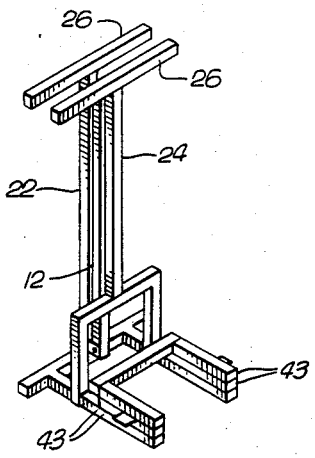
FIG. 9 is a diagrammatic perspective view of the portion of the invention as depicted in FIG. 6 in a collapsed configuration.

The exercising device has a front end 32 adjacent the partners region and a back end 34 adjacent the exercising region. The lower track arrangement 14 further comprises a front bar 36, supported by a pair of spaced apart short upright elements 38 are disposed adjacent the front end 32 of the exercising device. A horizontal bar 40 joined beneath the upright elements 38 supports the upright elements 38. The horizontal bar 40 is disposed normal to and joined to the lower tracks 16. The upright elements are coupled to hinged sliders 54 movable along the lower tracks 16, and thus enables the frame 10 to be collapsed as shown in FIGS. 7 and 8. The tracks 16 have plural segmented portions 43 and have hinges 45 for folding.

The structural cabling arrangement 28 generally contributes to maintain upright and stabilizes the risers 22, 24. The cabling arrangement 28 comprises twisted steel cable having a coating, such as polyurethane for ease of handling. The cabling arrangement 28 comprises a pair of end cables 42 arranged in an inverted "V" formation tranverse to a nominal plane of the frame 10 and are coupled from the opposing spaced apart ends 44 of a lower cross bar 15 to an upper end 46 of the vertical riser 22 at the rear end of the frame 10. At the front end 32 of the frame 10, a pair of end cables 48 arranged in an inverted "V" formation transverse to a nominal plane of the frame 10 are coupled from the opposing spaced apart ends 44 of the bar 36 to the upper end of the vertical riser 24 at the front end of the frame 10.

A second cabling arrangement 50 comprises a pair of cables arranged in a spaced apart and parallel "V" formation each of which are disposed in a plane nominally parallel to the plane of the frame 10. The cabling arrangement 50 comprises two sets of cables 52, on each side of the plane defined by the risers 22, 24, each separate cable 52 extending from one end of the upper cross bars 26, to the outermost ends of the protruding members 30. The second cabling arrangement 50 along with the upper crossbars 26 generally rigidly maintains the outwardly extending square relationship of the frame 10.

Figure 5:
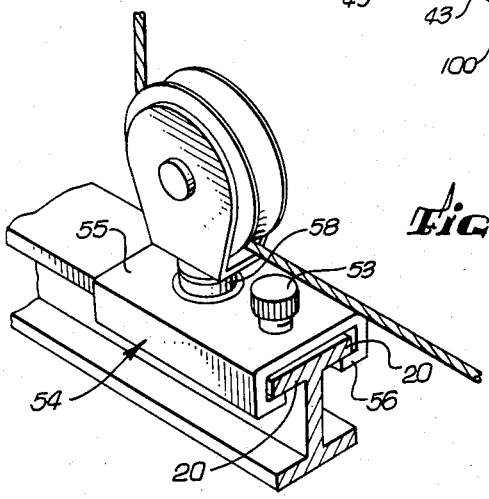
FIG. 5 is a detail perspective view of a track and rail arrangement depicted in FIG. 1 in accordance with the invention.

The tracks 12, 16 and the risers 22, 24 preferably have an H-beam cross-section as depicted in FIG. 5. In addition to providing strength to the frame 10, the H-beam cross sections define outwardly extending longitudinal flanges 20 which generally extend the length of the tracks 12, 16 and the risers 22, 24. Sliders 54 comprises front plates 55 and inwardly directed longitudinal flanges 56 extending from and folded inward from the front plates 55. The longitudinal flanges 56 engage in movable relationship the outwardly extending longitudinal flanges 20 of the H-beams. Means such as thumbscrews 53 extending through apertures in the risers, generally normal to the plane of the longitidal flanges 20, are provided for nominally fixing the positioning of the sliders 54 with respect to the tracks 12, 16 and the risers 22, 24. Bearings 58 may be used facilitate the movement of the sliders 54 along the risers 22, 24 and the tracks 12, 16.

A hinge 57 couples a slider 54 disposed on the riser 22 to the upper track 12. A thumbscrew 53 coupled to the slider 54 fixes the upper track 12 in a position normal to the riser 22, thereby maintaining the frame 10 in a square configuration. The slider 54, being movable along the riser 22, however, allows the frame to be folded, as indicated in FIGS. 6, 7, 8 and 9.

The pulley arrangement 18 comprises an upper pulley group comprising a partner supporting pulley block 60 and an offset fiddle block 62 having upper and lower pulleys 59, 61 disposed adjacent the front end 32. The fiddle block 62 is affixed to one of the sliders 54 and thus is adjustably movable along the upper track 12. The partner supporting pulley block 60 is disposed directly above a harness 63 for receiving the partner, and is coupled to the friction block 64 for enhancing the effective resistive force exerted by the weight of the partner. An upper line 66, extending from the friction block 64 passes through the pulley 60 and then through the pulley 59 of the offset fiddle pulley block 62 where the force is downwardly transmitted through a coupling 68. The upper line 66 then extends upwardly from the coupling 68 through the lower pulley 61 of the fiddle pulley block 62, and out through a cam clete 82. Once the line 66 is fixed by the cam clete 82, the effective length of the upper line 66 is no longer adjustable. Thus, a movement of the upper line 66 causes a corresponding movement of the lower line 102, though reduced by a multiple as a result of the multiple pulleys 76 extending from the coupling 68.

Similarly, a slider 54 coupled to the upper track 12 has a pulley block 67 nominally disposed above the region of an exercising individual and another pulley block 67 spaced apart from the first pulley block 67 and adjacent the riser 22 at the back end 34 of the frame 10. The pulley blocks 67 are staggered to prevent intereference with exercising. A line 69 extends through both the pulley blocks 67, the line 69 extending downwardly from the innermost pulley block 67 being couplable to exercise means such as a bar 71 or exercise handles 73, here used generally for pull down exercises such as lateral pull down or tricep pushdown exercises. The line 69 also has a U-bar 111 supporting shackles 112 for receiving clips 114 coupled to the lower line 102. Adjacent the pulley block 67 closest to the riser 22 is disposed an additional slider 54 having longitudinal flanges 56 engaging and movable along the riser 22, yet remains fixed by the tightening of the thumbscrew 53. A hinged portion 72 coupled to this slider 54 is coupled to the upper track 12 for generally maintaining the track 12 normal to the riser 22, yet allows folding and collapsing of the frame when the thumbscrew 53 is loosened, as shown in FIGS. 6, 7, 8 and 9. The coupling 68 is joined to a slider 54 coupled to the flanges 20 of the upright riser 24, thus, movable along a vertical axis. The coupling 68 has a pulley 74 for receiving the line 66. Beneath the pulley 74, the coupling 68 has bar 75 which suppports two groups of pulleys 76 in parallel spaced apart relationship about an axis normal to the plane of the frame 10 on opposing sides of the coupling 68. The two groups of pulleys 76 divide the effect of the resistive force transmitted by the exercising partner.

The harness 63 for supporting a second person or partner is disposed beneath and coupled to the friction block 64. The friction block 64 is a coupled to the upper line 66 which comprises ⅝" dacron cord and is theaded through the friction block 64 and under the partner supporting pulley 60. Dacron is preferably as it resists stretching, is stong and durable. The friction block 64 allows a resistive force to be adjusted and which is ultimately transmitted to an exercise bar 71 or handlebars 73, The friction block 64 has a dial 80 for force adjustment. The upper line 66 provides variable length adjustment for force up exercises. The upper line 66 extends from the friction block 64 which supports the harness 63 and couples the partner to the movement of the exercising individual using the system. The line 66 is further threaded through a cam clete 82 for adjusting the length of the upper and lower lines 66. A cam clete 82 extends from the partner to the exercise bar 71 or handlebars 73 to allow variations in position for different exercises and for the comfort of the individual doing the exercising and the partner.

Figure 11:
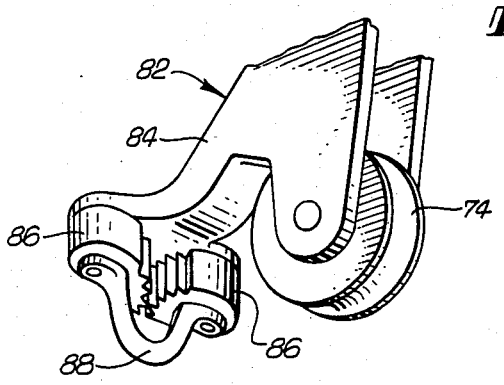
FIG. 11 is a detail perspective view of a portion of the invention depicted in FIG. 1.

The cam clete 82, best depicted in FIG. 11 (prior art) has an arm 84 extending to the offset pulley block 62. On the end of the arm are a pair of spaced apart spurs 86 movable about spaced apart parallel axes, and a bridge retainer element 88 joining the spurs 86 for retaining the upper line 66 when released from the spurs 86. The spurs 86 allow the release of the upper line 66 as the upper line 66 is loosely released into the region of the bridge retainer element 88, while grasping the upper line 66 when rapidly released. The pulley block 62 is positioned so that the upper line runs through the wheel of the pulley block 62 and through the spurs 86. When the pulley is released between the spurs 86, they are gripped by the spurs 86 and prevent further travel of the upper line 66. As an alternative to the cam clete 82, the pulley 74 may be replaced by a shackle to which the line 66 is affixed.

It should be appreciated that the exercising device in accordance with this invention is therefore adjustable, both in force exerted or resisted, depending on the exercising setup, and is further adjustable in height or length of the upper line 66, both to the individuals using the equipment and for the particular type of exercise to be performed.

A futon 90 comprises three dense foam sections 92, each having a fabric covering 94 and each hinged to each other by a fabric hinge 96. The futon 90 allows exercising to occur either in a sitting, standing or lying position, and further allows the exercising apparatus to be conveniently folded up after exercising is over, to become an attractive and functional piece of furniture. The foam sections 92 preferably have a high density, similar that of commonly used exercising mats.

The lower tracks 16 have parallel pulley blocks 100, as best viewed in FIGS. 1 and 3. A lower line arrangement comprising a pair of spaced apart lower lines 102, each lower line 102 extending from beckets 104 disposed in the central region of the coupling 68 and then extend over and about the pulley groups 76 to obtain a mechanical advantage from the multiple pulleys of each group 76. The lower lines 102 extend over the outermost pulleys of the pulley groups 76 and under an adjacent pulley 106 disposed on the front bar 36. Outermost pulleys 108 are disposed on the front bar 36 adjacent the short upright elements 38. The lower lines 102 extend downward over the pulleys 108 and under and through the pulley blocks 100 where they travel to pulley blocks 110.

It should be recognized that the pulley blocks 100 and 110 are coupled to sliders 54, thereby allowing the position of the blocks 100, 110 to be adjusted as needed.

The lower lines 102 transmit the length adjustment by the partner from the upper line 66 and further, in this particular example, provide an eight to one advantage in the effective transmitted force, for force up and force down exercises, simultaneously. A coupling arrangement 68 interconnects the short line 102 with the upper line 66.

The lower lines 102 are extended about and through the pulleys 110, and then to the handlebars 73 or to the exercise bar 71. It should be recognized that the handlebars 73 may be interchanged with the exercise bar 71, depending on the type of exercising activity to be conducted. Thus, the exercise bar may be joined above the pulleys 110 to the lines 102.

The exercise bar 71 is preferably covered with 1 cm. molded high density foam 77 for comfort. The exercise bar 71 comprises a transverse portion 79, a pair of angled end portions 81 having first and second apertures or loops 83 on each angled end portion 81 for attachment to the lower lines 102.

Figure 10:
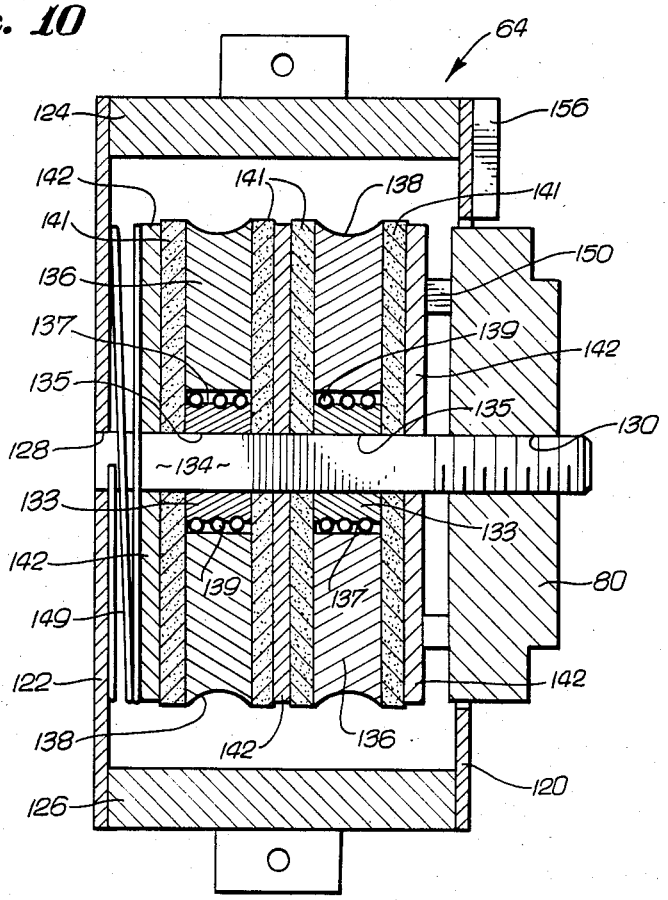
FIG. 10 is a detail cross-sectional view of a friction block in accordance with the invention taken along lines 10—10 of FIG. 1.

With particular reference to FIGS. 1, 2 and 10, the frictional block 64 generally comprises front and back plates 120, 122 to retain the block 64. Top and bottom spreaders 124, 126 maintain the front and back plates 120, 122 in parallel spaced apart relationship. A square aperture 128 passing through the front plate 120 and a square aperture 130 passing through the back plate 132 receives a threaded center post 134. The center post 134 couples the block 64 and allows tightening of the friction dial 80. Disposed about the center post 134 are sheave adaptors 133 having an inner cross sectional aperture 135 mating with that of the post 134 and an outer circular surface 137. Disposed on the outer circular surfaces 137 of the sheave adaptors 133 are roller bearings 139.

A pair of spaced apart serrated sheaves 136 having rough concave annular surfaces 138, disposed normal to the post 134 betweeen the front and back plates 120, 122 allow rope to spin through the block 38 without slipping. The roller bearings 139 allow the sheaves 136 to rotate freely about the post 134. Friction disks 141 of material such as leather impregnated with graphite, are disposed on opposite sides of each of the sheaves 136 for engaging the sheaves 136 and exerting resistive forces tending to prevent the sheaves from rotating. Circular clutch plates 142 are disposed between the back plate 122 and one of the sheaves 136. The clutch plates 142 allows smooth spinning of the sheaves 136, when not tightly compressed against the friction disks 141, yet provide a smooth uniform pressure when force is applied. The frictional force applied from the friction disks 141 to the sheaves 136 thereby exerts a resistive force on the line 66. Adjacent and parallel to and engaging the back plate 122, a compression spring 149 allows smooth application of force, distributing a force gradient within the friction block 64.

A transducer 150 is disposed between the friction plate 142 and the dial 180. The pressure transducer 150 has an inductance which is altered by the force exerted on it and bears a relationship to the frictional resistive force which is exerted by the second partner in the harness 63. This force exerted is the gravitational force of the partner, which is then enhanced by the frictional resistance of the frictional block 64. It is a force related to this enhanced force that is applied to the transducer 150. The transducer 150 is coupled to an analog to digital converter, the resulting signal is processed by providing a digital indication relating to the resistive force of the block exerted on the upper line 66. A digital signal relating to the resistive force, responsive to the transducer is then available and applied to a digital readout, such as a liquid crystal display 156.

The harness 63 comprises a webbing as in a swing. The harness 63, however, could be of a form that would fully surround the partner. A support bar 158 is suspended from the friction block 64. The support bar 158 has opposing ends having lines 160 extending to ends of the webbing.

In some situations, it may be preferable to have the upper track 12 joined directly to the ceiling of a home. A rigid coupling to a ceiling beam, then can eliminate the need for the structure of the risers 22, 24 and the cabling arrangements 28, 50. It is preferably then to have the track 12 have on the outwardly extending flanges 20, apertures for receiving lag screws and joining the track to a ceiling beam or stud.

In use, either the handlebars 73 or the exercise bar 71 is affixed to the lower lines 102 above the pulleys 110. The individual doing the exercises can then engage the exercise bar 71, for example. Depending on the particular exercise, the individual will either be in a sitting, standing or lying position and the futon 90 will be positioned accordingly. The exercising partner or spotter will engage the harness 63 and adjust the dial 80 of the frictional pulley block 38 for an appropriate weight will be shown on the display 82 of the friction block 64.

The length of the upper line 66, which controls the starting postion of the exercise bar 71 is determined in part by the position of the line 66 extending through the cam clete 82, which is adjusted by the individual in the harness 63 by pulling on the cam clete 82 and allowing the proper amount of rope to be taken up or let out, and then by having the cam spurs 84 of the cam clete engage the line 66. At this point, exercises may begin.

The individual doing the exercises, for example, in doing curls, pulls up on a weight which is reflected on the dial 80 of the friction block 64. The weight of the second individual thus controls the upward force exerted by the person engaging in the exercising activity. Should the individual then stand up or be released from the harness, the added weight of the exercuse bar 71 is essentially eliminated, except for the actual weight of the exercise bar 71 and certain other minor weight factors.

The futon 90 can then be moved to a chair or extended position for exercising different sets of muscles utilizing the same exercise bar 71.

Figure 6:
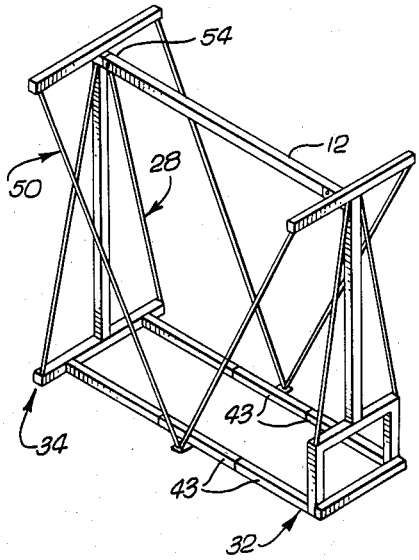
FIG. 6 is a diagrammatic perspective view of a portion of the invention depicted in FIG. 1.

The device is collapsable and may be folded for compact storage prior to purchase, when not in use, or if it is desired to have the equipment moved or removed yet extends to take advantage of available space. This is best shown diagrammatically in FIGS. 6, 7, 8 and 9. In FIG. 6, the frame 10 is shown having a square configuration, maintained by the structural cable arrangements 28, 50. The upper track 12 is coupled to a slider 54 as shown in FIG. 5 with a thumbscrew which allows the upper track 12 to be moved, adjacent the back end, downwardly to the posiiton as shown in FIG. 7. Similarly, sliders 54 coupled to the short upright elements 38 may be loosened by thumbscrews 53 and then moved laterally from the front end 32 to the back end 34 of the lower tracks 16 as shown in FIG. 8. The segments 43 of the lower tracks 16 are hinged and may then be folded toward the back end for compact storage.

Thus, an exercising device has been described which generally utilizes the active involvement of a second person. No additional weights are necessary since the exercising weight is supplied by the partner and moderated by the multiple pulley banks and the adjustable friction block. The advantages of this involvement are likely to create a motivation to engage in exercising and thus encourage physical fitness.

While the invention has been particularly shown and described with reference to particular examples thereof, it will be understood by those skilled in the art that various changes in form and details may be made therein without departing from the spirit and scope of the invention.

What is claimed is:

1. A two person cooperative exercising device for use by an exercising individual and a partner comprising:

exercising means for transmitting a resistive force for exercising to an exercising individual;

means for supporting a partner and providing a force related to the gravitational weight of the partner, the partner supporting means spaced apart from the exercising means;

a pulley arrangement including line means for transmitting the partner related force of the exercising partner from the partner support means to the excercising means, the pulley arrangement coupled to the exercise means;

upper support means for supporting the pulley arrangement to movably support the partner supporting means;

lower support means for supporting the pulley arrangement to receive the partner related force for the exercising means;

means for retaining the upper support means in fixed relationship to the lower support means; and means for adjusting the partner related gravity force, the adjusting means coupled to the pulley arrangement, said pulley arrangement being adjustable by the partner at one station and the partner's related gravity force being transmittable to the exercising means at another station whereby the partner may supply and adjust the significant portion of the force transmitted to the exercising individual, thus providing a two person cooperative participation apparatus for an exercising program.

2. The invention as set forth in claim 1 and in which: the pulley arrangement comprises a first pulley group coupled to the upper support means and a second pulley group coupled to the lower support means.

3. The invention as set forth in claim 3 and in which the pulley arrangement including line means for engaging the first and second pulley groups and transmitting the gravitational related force from the first pulley group to the second pulley group and to the exercising partner, the line means comprising coupling means for coupling the second pulley group to the first pulley group.

4. The invention as set forth in claim 3 and in which the line means comprising upper line means for transmitting the gravitational related partners force to the coupling and lower line means for transmitting a multiple reduction of the gravitational related partners force transmitted to the coupling to the exercising means, the upper line means extending about the upper pulley group and the lower line means extending about the lower pulley group, the lower line extending about the lower pulley group in multiple paths in relationship to the upper line to provide an advantage to transmit the multiple force reduction to the exercising means.

5. The invention as set forth in claim 3 and in which the means for adjusting the partner related force comprising an adjustable friction block for controlling the force transmitted to the exercising means, the adjustable friction block controllable by the exercising partner; the invention further comprising upper line means for transmitting a force from the first pulley group to the second pulley group; and lower line means for transmitting a force to the exercising means through the second pulley group;

the exercising means coupled to the lower line, whereby the force established by the variable force means and the gravitational related force exerted by the second partner is transmitted through the pulley arrangement to the lower line means and to the exercising means.

6. The invention as set forth in claim 5 and comprising:

harness means for supporting a partner, the harness means coupled to the variable force means whereby the combination of the gravitational weight of the partner exerted on the harness means combined with the effect of the adjustable friction block means as transmitted through the first and second pulley groups provide range of suitable exercising resistance for the exercising, the first and second pulley groups effectively reducing the gravitational related weight applied by the partner in the harness means, while the friction block adjustably increases the effective exercising resistance.

7. The invention as set forth in claim 5 and comprising futon means for allowing the exercising individual to be in various positions during exercising, the futon means comprising a plurality of firm semiresilient pads and fabric hinge means for interconnecting the pads, the futon means disposed adjacent the exercising bar.

8. A two person cooperative exercising device for an exercising individual and a partner comprising:

frame means for supporting a pulley arrangement for transmitting a force related to a downward gravitational weight of an partner to an individual as a resistive exercising force;

harness means for supporting an partner to apply a gravitational related force of the exercising partner to a pulley arrangement, the harness means suspended from the frame means;

exercising means for transmitting a resistive force for exercising to an exercising individual;

a pulley arrangement including line means for transmitting the gravitational related force of the exercising partner from the harness means to the exercising means, the pulley arrangement coupled to the frame means; the frame means comprising:

upper lateral support means for supporting the pulley arrangement to moveably support the exercising partner means;

base means for supporting the pulley arrangement to the partner related force for the exercising means; and in which the pulley arrangement comprising a first pulley group couppled to the upper lateral support means and a second pulley group coupled to the base means;

the line means comprising a coupling, upper line means for transmitting the gravitational related partners force to the coupling and lower line means for transmitting the partners force transmitted to the coupling to the exercising means, the coupling interconnecting the upper and lower line means, the upper line means extending about the upper pulley group and the lower line means extending about the lower pulley group, the lower line extending about the lower pulley group in multiple paths in relationship to the upper line to provide an advantage to exert a multiple force reduction to the exercising means; and means for adjusting the partner's gravitational related related force, the force adjusting means coupled to the pulley arrangement and adjustable by the partner to provide an adjusted gravitational related force and the adjusted gravitational related force transmittable to the exercising means whereby the exercising partner may supply and adjust the significant portion of the force transmitted to the exercising individual, thus providing cooperative participation apparatus for an exercising program.

9. The invention as set forth in claim 8 and in which:

the force adjusting means comprising a friction block for controlling the force transmitted to the exercising means, the variable force means controllable by the partner;

the harness means coupled to the friction block whereby the combination of the weight of the partner combined with the effective resistence force of the friction block and the relationship of the first and second pulley groups provide a range of suitable exercising resistance for the individual, the first and second pulley groups effectively reducing the weight applied by the gravitational weight of the partner in the harness means, while the friction block adjustably increases the effective exercising resistance; and the exercising means coupled to the lower line, whereby the force established by the friction block and the force exerted by the exercising partner is transmitted through the pulley arrangement to the lower line and to the bar.

10. The invention as set forth in claim 9 and in which the frame means being collapsable for storage, the frame means comprising:

spaced apart upright means for supporting the upper lateral support means from the base means;

cable means for maintaining the base means in tension with the upper lateral support means to prevent collapse of the structure while in use, yet allow the frame to be collapsable when not in use.

11. The invention as set forth in claim 12 and in which the frame comprises a generally square configuration;

the base means comprises a pair of longitudinal members and a plurality of transverse members interconnecting and maintaining the longitudinal members in generally parallel spaced apart relationship; and means for coupling the cable means to provide an exercise clearance region, comprising cross members transversely disposed at opposing ends of the upper support members and outwardly extending portions extending centrally from the longitudinal members, the cable means comprising cable lines extending from ends of the cross members to the outwardly extending portions of the longitudinal members in spaced apart relationship on opposing sides of the base means.

12. The invention as set forth in claim 13 and in which the frame means comprises front and rear regions, the rear region comprising rear upright means for supporting the lateral support means, the upright means having outwardly extending longitudinal flange means for receiving a slider in movable relationship, and a first slider engaging the flange means and longitudually movable along the flange flange means of the upright means, the first slider fixable adjacent an upper end of the upright means, the first slider having a hinged portion movable about an axis normal to the upright means, the hinged portion fixedly coupled to the lateral support means, whereby the first slider, when released is movable from the region adjacent an upper end of the upright means, toward the base means so that the frame means may be collapsed for storage.

13. The invention as set forth in claim 12 and in which the front region having upright means for supporting the lateral support means, the upright means comprising second slider means coupled to the base means in normally fixed, yet slidably movable relationship from the front region toward the rear region, the second slider having a hinged portion movable about an axis normal to a nominal plane of the frame means, the hinged portion fixedly coupled to the front upright means, whereby in collapsing the frame means, the front upright means is movable towared the rear upright means.

14. A two person cooperative exercising device comprising:

frame means for supporting a pulley arrangement; excercising means for transmitting a resistive force for exercising to an exercising individual;

a pulley arrangement including line means for transmitting the gravitational related force of the partner from the partner support means to the exercising means, the pulley arrangement coupled to the frame means;

harness means for supporting an partner and providing a force related to the gravitational weight of the partner;

means for adjusting the partner's gravitational related force, the adjusting means coupled to the pulley arrangement, adjustable by the partner and transmittable to the exercising means;

upper lateral support means for supporting the pulley arrangement to support the harness means movably along a vertical axis;

base means for supporting the pulley arrangement to receive the partner's gravitational related force for the exercising means;

the pulley arrangement comprises a first pulley group coupled to the upper lateral support means and a second pulley group coupled to the base means;

the line means comprising a coupling and upper line means for transmitting the partners gravitational related force to the coupling and lower line means for transmitting the partners force transmitted to the coupling to the exercising means, the upper line means extending about the upper pulley group and the lower line means extending about the lower pulley group in multiple paths in relationship to the upper line means to provide an advantage to effectuate a multiple force reduction to the exercising means;

adjustable force means, other than the means for adjusting the partner's gravitational related force, for controlling the force transmitted to the exercising means, the adjustable force means controllable by the partner;

the harness means coupled to the adjustable force means whereby the combination of the weight of the partner combined with the effect of the adjustable force means provide range of suitable exercising resistance for the exercising individual;

the first and second pulley groups effectively reducing the weight applied by the gravitational weight of the individual in the harness means, while the adjustable force means adjustably increasing the effective exercising resistance;

the exercising means coupled to the lower line, whereby the force established by the adjustable force means and the force exerted by the second partner is transmitted through the pulley arrangement to the upper line and to the bar;

spaced apart upright means for supporting the upper support means from the base means;

cable means for maintaining the base means in tension with the upper means to prevent collapse of the structure while in use, yet allow the frame to be collapsible when not in use, the frame means comprising a generally square configuration; the base means comprising a pair of spaced apart longitudinal members and a plurality of transverse 70 members interconnecting the longitudinal members; and means for coupling the cable means to maintain an exercise clearance region comprising transverse cross members disposed at opposing ends of the upper support member, the cable means comprising cable lines extending from ends of the cross members to the central region of the base means in spaced apart relationship on opposing sides of the base means, thereby providing a collapsible two person exercising device providing an adjustable force related to the weight of the partner.

15. The invention as set forth in claim 14 and in which the variable force adjusting means comprising an adjustable friction block for adjusting the force exerted by the second individual on the exercise means when used by the exercising individual.

16. The invention as set forth in claim 14 and comprising cam clete means for adjusting positioning of the harness means and the exercising means by adjusting the length of the upper line, thereby adjusting the position of the lower line, and hence the position of the exercising means.

17. The invention as set forth in claim 14 and comprising futon means for allowing the individual exercising to exercise from a variety of positions, the futon means disposed adjacent the rear end of the frame, the futon means comprising plural semiresilient pads, and fabric hinge means for foldably interconnecting the pads; and in which the cable means comprises twisted steel cable having a thermoplastic disposed thereon; and the exercising means comprising a bar having connecting means at either end for receiving line from the lower pulley groups.

18. The invention as set forth in claim 14 and in which the adjustable friction block comprises:

a pair of facing plates disposed in spaced apart parallel relationship to hold the block together;

top and bottom spreaders maintaining the facing plates disposed in spaced apart relationship;

a center post extending between the first and second plates, and preventing friction plates from rotating;

a clutch plate and an areal friction material for applying a frictional force to the sheave, the cluth plate and the friction material disposed in parallel relationship to each other and normal to the axis of the sheave;

a serrated sheave to allow rope to spin through the pulley block without slipping;

a threaded center post allowing the tighting of friction dial, upon applying force; and dial means for allowing the application of force between the dial and the back plate.

19. The invention as set forth in claim 18 and comprising means responsive to the force and the back plate for providing an indication responsive to the force; and display means responsive to the indication for providing a visual display of the effective resistive force exerted by the exercise means.

20. The invention as set forth in claim 19 and in which the means responsive to the force and the back plate comprise an analog force transducer and the display means comprises analog to digital converter means for providing a digital indication responsive to the force transducer bearing a relationship to the weight exerted by the exercise means and digital display means coupled to the analog to digital converter means for displaying a visual digital indication of the weight exerted by the exercising bar means.

21. The invention as set forth in claim 14 and comprising lag bolt means for fastening the upper lateral support means to a ceiling beam.

22. The invention as set forth in claim 14 and in which the lower pulley group comprises first and second parallel spaced apart pulley groups linked in parallel to the coupling, each of the first and second pulley groups having separate lines couplable to the exercising means, whereby the separate lines may be individually extended to either a single or multiple exercising bars.

* * * * *